US005668848A

United States Patent [19]

Rieger

[11] Patent Number: 5,668,848

[45] Date of Patent: Sep. 16, 1997

[54] X-RAY TARGET TAPE SYSTEM

[75] Inventor: Harry Rieger, San Diego, Calif.

[73] Assignee: Jamar Technology Co, San Diego, Calif.

[21] Appl. No.: 585,695

[22] Filed: Jan. 16, 1996

[51] Int. Cl.[6] ..... H01J 35/10

[52] U.S. Cl. ..... 378/125; 378/119

[58] Field of Search ..... 378/126, 119, 378/125

[56] References Cited

U.S. PATENT DOCUMENTS

| | | | |
|---|---|---|---|
| 3,647,984 | 3/1972 | Watanabe | 179/100.2 T |
| 4,764,826 | 8/1988 | Estes | 360/132 |
| 4,896,341 | 1/1990 | Forsyth et al. | 378/125 |
| 4,939,715 | 7/1990 | Vogelgesang et al. | 360/93 |
| 5,006,184 | 4/1991 | Manusch et al. | 156/577 |
| 5,544,133 | 8/1996 | Sin | 369/14 |

*Primary Examiner*—Don Wong
*Attorney, Agent, or Firm*—John R. Ross

[57] ABSTRACT

A efficient point source x-ray target tape assemble. A tape is wrapped helically around a rotating drum a little more than one complete turn so as to create an overlap section where a section of the tape is positioned parallel and adjacent to a separate section of the tape. The tape advances slowly across the outside surface of the drum at a speed which is a small fraction of the tangential surface speed of said drum. In a preferred embodiment a pulsed laser beam is focused on the tape at a fixed spot in space through which the tape moves in order to create x-rays from plasma generated by very high intensity ablation of the tape material. The combination of the drum rotation and the tape advancement across the surface of the drum permits substantially full utilization of the tape material for generation of x-rays.

7 Claims, 2 Drawing Sheets

X-RAY TARGET TAPE SYSTEM

The present invention relates to x-ray target tapes and in particular to multi-pass x-ray target tapes.

BACKGROUND OF THE INVENTION

High intensity radiation, such as a stationary pulsed laser beam may be focused on a moving target tape (e.g. copper, stainless steel, etc.) in order to generate x-rays. The intersection of the radiation and the tape defines a point source from which the x-rays radiate. In the process, holes or spots are formed on the target tape. Since the spatial position of the x-ray point source must be stationary, the tape must move in a pattern to allow a fresh portion of the tape to be exposed to each succeeding laser pulse.

The conventional approach for a target tape is to move the tape from the feed reel to the collect reel. This approach utilizes only a single straight line along the tape. A more efficient approach would be to step the tape drive assembly vertically (for a horizontally moving tape) every time the tape reaches the end for multiple vertical passes. The drawbacks of this approach are (1) that the tape is often deformed by the laser ablation process which results in some unstable x-ray generation and (2) the tape drive mechanism requires sophisticated motion control.

It is known that in standard video recorders in common use today, the recording head rotates at a slight angle to the tape and the tape advances relatively slowly so that information can be extracted from almost the entire area of the tape.

What is needed is a mechanically simple point source x-ray tape drive that would enable utilization of the entire tape surface as the tape moves from the supply reel to the collect reel.

SUMMARY OF THE INVENTION

The present invention provides an efficient point source x-ray target tape system. A tape is wrapped helically around a rotating drum a little more than one complete turn so as to create an overlap section where a section of the tape is positioned parallel and adjacent to a separate section of the tape. The tape advances slowly across the outside surface of the drum at a speed which is a small fraction of the tangential surface speed of said drum. In a preferred embodiment a pulsed laser beam is focused on the tape at a fixed spot in space through which the tape moves in order to create x-rays from plasma generated by very high intensity ablation of the tape material. The combination of the drum rotation and the tape advancement across the surface of the drum permits substantially full utilization of the tape material for generation of x-rays.

DETAILED DESCRIPTION OF PREFERRED EMBODIMENTS

Figure 3:
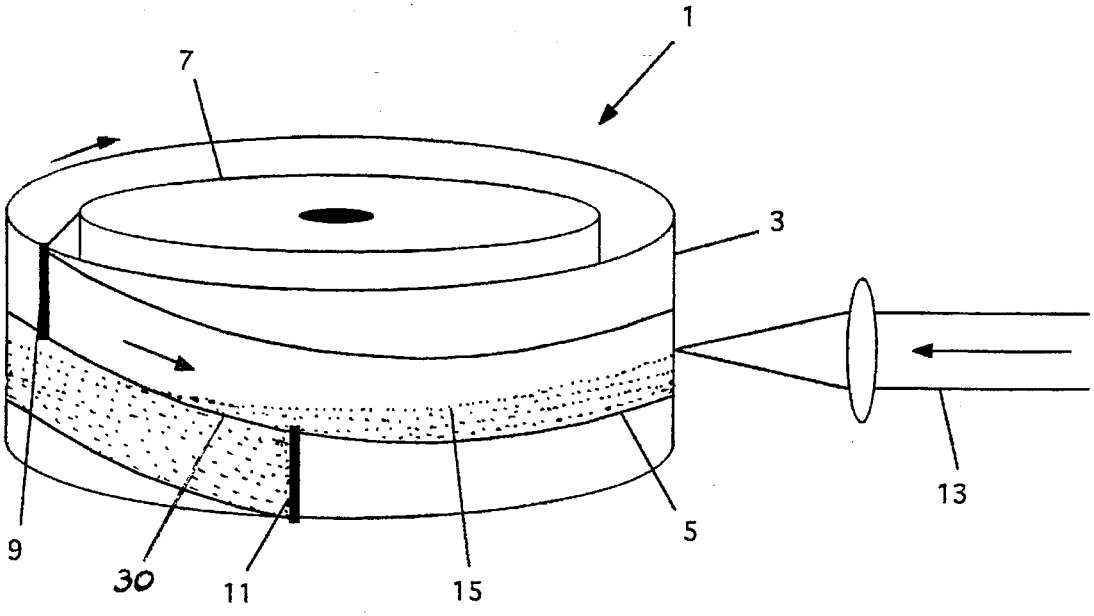
FIG. 3 is a drawing showing the rotating drum assembly and the laser focal spot.

The objective of this invention is to maximize the utilization of a target tape without the need to run the same tape back and forth. FIG. 3 shows an x-ray target tape system 1 with tape 15 coming through a feed slit 9 from a supply reel 7, wrapping helically around drum 3 for about 1⅛ turn and then back into a take up slit 11 to the collect reel 29 (not shown on FIG. 3). A pulse laser beam 13 is focused to a small spot and the pulses ablate material from the tape creating a very hot plasma and x-rays radiating from the spot at the intersection of the beam and the tape. The process leaves a series of spots on the tape which define a circumference around the drum which is in a plane which is perpendicular to the axis of rotation of the drum. Since the tape is aligned at a slight angle with this plane, the line is at a slight angle with the top and bottom boundaries of the tape. The spacings between the lines on the tape are due to the slow advancement of the tape between the supply and collect reels.

For example: a system that uses a 1,000 Hz (1 ms between pulses) pulsed laser, and 1 mm spacing between spots would require a drum surface speed ($\omega R$) of 1 m/s, where $\omega$ is the angular velocity of the drum and R is the radius of the drum. A drum with 0.1 m radius would turn at frequency $f=\omega/2\pi\sim1.6$ revolutions per second or ~96 RPM. The spacing between the horizontal lines is determined by the slow advancement of the tape from the supply to the collect reels during a single revolution of the drum. A 1 mm spacing using 1 cm wide tape would require tape advancement of 1/10 of the drum circumference (L) for every revolution of the drum. Since the circumference of the drum, $L=2\pi R=\sim60$ cm, the tape must advance about 6 cm for each turn of the drum. Since the drum in this example is rotating once each 0.625 seconds the tape speed should be about 10 cm/second. Thus, each specific section of the tape makes 10 trips around the axis of the drum while riding on the outside surface of the drum. On each trip around the drum, the path of a specific tape section is about 1 mm lower than the path made by the tape section on its prior trip around.

Figure 1:
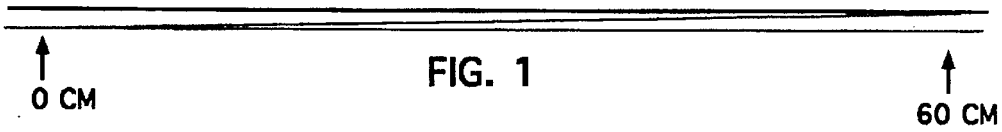
FIG. 1 is a drawing showing the tract of a series of spots on a 60 cm tape representing one drum rotation of a preferred embodiment.
Figure 2:
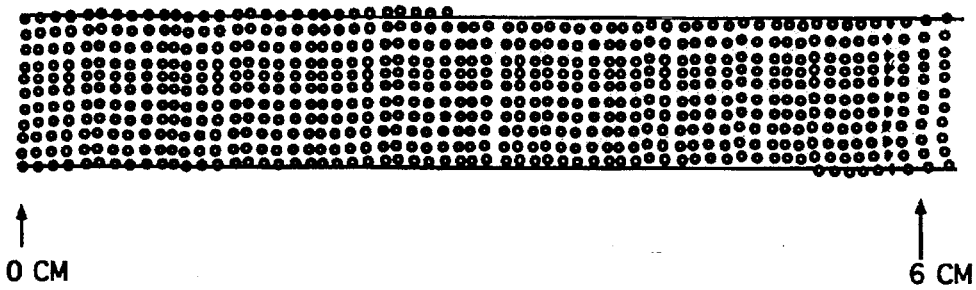
FIG. 2 shows a 6 cm section of a 1 cm wide tape containing about 600 spots.

FIG. 1 shows the line of spots produced on a 60 cm section of the tape representing one turn of the drum described in the above example. Due to the drum rotation and the angle of the tape on the drum, a sloped line of spots starts at the top of the tape and ends at the bottom of the tape at a distance on the tape of about 60 cm after about one revolution of the drum. As the drum continues its rotation the spots (created by ablation by the pulsed laser) will start again at the top of the tape. But since the tape advanced about 6 cm, the new sloped line will not overlap the previous one but will appear about 1 mm below the line of spots created during the prior rotation. FIG. 2 shows the approximate spacing of the spots on a 6 cm section of the tape.

Figure 4:
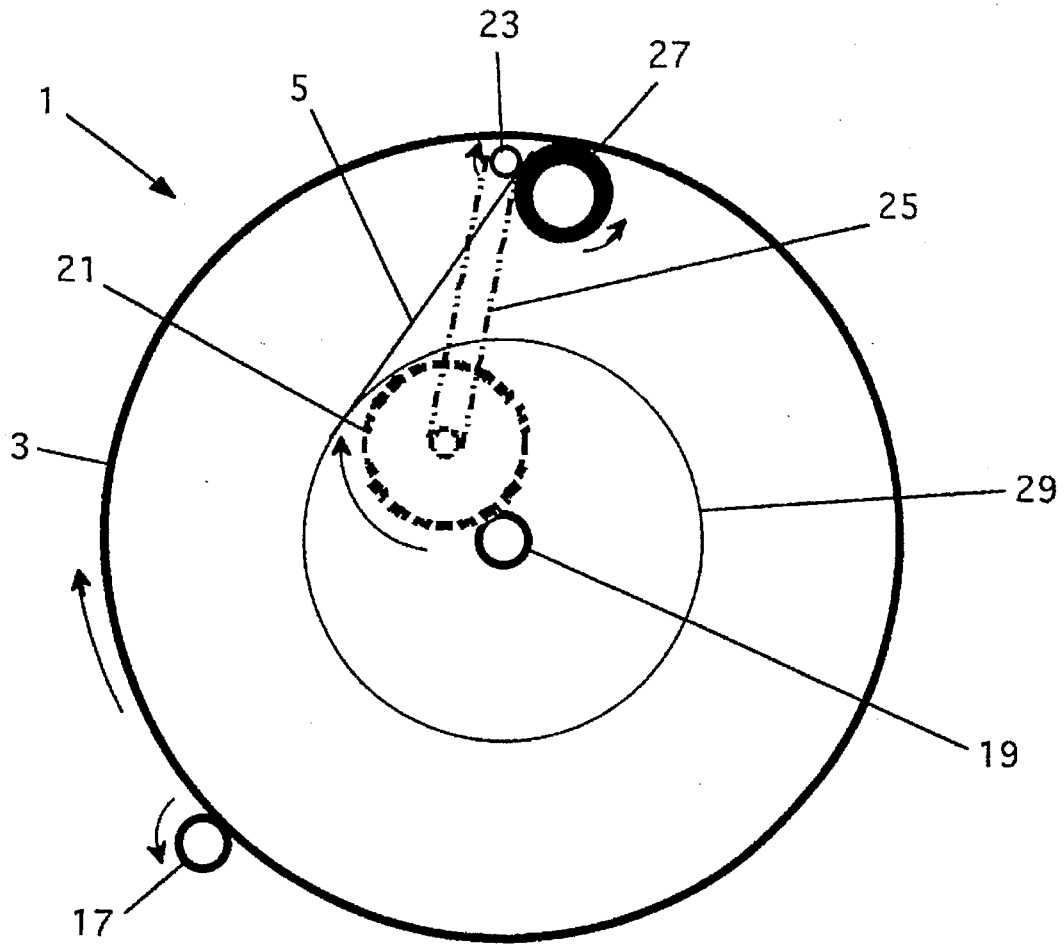
FIG. 4 is a drawing showing the rotating drum's drive mechanism.

Additional detail of the preferred target tape system is shown in FIG. 4. A motor with shaft 17 drives the drum assembly 1 clockwise. The drum assembly includes all the shown parts other than center shaft 19, collect reel 29, and drive motor shaft 17. Wheel 21 (engaged to 19) which is placed underneath the collect reel 29 is rotating clockwise with respect to the rotating drum. Constant tape drive pin 23 is pressed against rubber wheel 27 and is rotated clockwise by drive belt 25 from wheel 21. Collect reel 29 can rotate by friction on shaft 19 to ensure proper collection of tape 5. The supply reel 7 shown in FIG. 3 is part of the rotating assembly and can rotate freely except for sufficient friction with respect to the rotating drum to provide a slight tension force on the tape.

In a preferred embodiment metallic tapes are used for generating x-rays for lithography by focusing high intensity laser pulses onto the tape and generating hot plasma.

To test the concept of my invention, a copper tape 0.001 inch thick and 0.5 inch wide was used to simulate slow feed on a drum. The tape was wound one full turn around a 4 inch diameter aluminum drum. The drum was stationary and the tape was pulled under about 1 pound tension. The motion of the tape was very smooth and the tension did not distort the soft copper at all. If, in some other applications, friction between the drum and the tape is a problem, small rollers could be incorporated into the surface of the drum to minimize the friction. When rollers are implemented, the surface of the drum will have small bumps that correspond to the rollers. These bumps should be small enough so as to not exceed the depth of focus of the laser system. The drum could include a shallow groove to precisely guide the tape.

When the tape is stored inside the drum as shown in the drawings, size of the drum should be large enough to fit the amount of tape that is required for a non-stop operation. For example, using 0.0005 inch thick by 0.5 inch wide tape on a 4 inch diameter reel would permit about 10 hours of non-stop operation at 400 Hz laser repetition rate. It is also feasible to design a smaller drum with large reels that are located above and/or below the drum. In such a configuration different size reels can be used with the same drum.

In some commercial applications, it may be important to replace the tape in a hurry to minimize down time. In such situations the entire drum (including the tape) can be made disposable similar to an audio or video cassette.

While the above description contains many specificities, the reader should not construe these as limitations on the scope of the invention, but merely as exemplifications of embodiments thereof. Those skilled in the art will envision many other possible variations which are within its scope. For example, the described mechanism in the preferred embodiment is very simplistic. Many different mechanisms can be used to achieve the approach of the rotating drum with the slow advancement of the tape for maximum tape utilization. All known drive and engagement approaches can be used. Different electronic control, motors, slip motion, and quick disengagement mechanism can be added to fulfill specific system requirements. For example: if the pulsed laser is not firing all the time, a quick engagement and disengagement of drive pin 23 (FIG. 3) can stop the tape advancement while the drum rotation continue, this mode of operation will not waste the tape when the laser is not firing.

High average power system may require large heat removal (few hundred watt) from the tape drive. A stationary heat exchanger around the rotating drum (very small gap) can remove the heat from the drum via convection. Future systems might provide a cw laser capable of producing a continuous x-ray beam in which case the series of spots would be a continuous line on the tape. Or the laser pulses could be at such a high frequency as to simulate a cw beam which could also produce a set of parallel lines on the tape.

It may be desirable to interrupt the laser when the beam is focused at the intersection of the two section of tape, shown at 30 on FIG. 3. This type of laser control is easy for persons skilled in the art of laser systems design. With such control it is not necessary for the two sections of tape to be immediately adjacent to each other as shown in FIG. 3 but they could be separated by some significant distance. This may be especially desirable when grooves for the tape is provided.

Accordingly the reader is requested to determined to determine the scope of the invention by the appended claims and their legal equivalents, and not by the examples that have been given.

I claim:

1. An X-ray target tape system comprising:

A) a tape drum defining a tape drum outside surface and a circumference,

B) a drum rotating means for rotating said drum,

C) a tape having a constant width, wrapped helically around said tape drum at least slightly more than one complete turn so as to define an overlap section such that a first section of said tape is positioned parallel to a second section of said tape, D) a tape advancing means for advancing said tape across the outside surface of said drum at a speed which is a small fraction of the tangential surface speed of said drum, the distance traveled by sections of said tape on the outside surface of said rotating drum defining an overlapping tape path, and E) a laser producing a laser beam focused on a fixed spot located on said overlapping tape path of said tape so as to ablate portions of said tape to produce x-rays.

2. A target tape system as in claim 1 wherein said at least slightly more than one complete turn is about 1⅛ turn.

3. A target tape system as in claim 1 wherein said laser beam is a pulsed laser beam.

4. A target tape system as in claim 1 wherein said tape is a metal tape.

5. A target tape system as in claim 4 wherein said metal tape is chosen from a group consisting of copper, stainless steel and tungsten.

6. A target tape system as in claim 1 and further comprising a tape supply reel and a tape take up reel.

7. A target tape system as in claim 6 wherein said supply reel and said take up reel are located inside said drum.

* * * * *

UNITED STATES PATENT AND TRADEMARK OFFICE

CERTIFICATE OF CORRECTION

PATENT NO. : 5,668,848
DATED : September 16, 1997
INVENTOR(S) : Rieger

It is certified that error appears in the above-identified patent and that said Letters Patent is hereby corrected as shown below:

Column 1,
Line 1, insert -- This invention was made with government support under Contract No. DAAL01-94-C-0006 awarded by the U.S. Army Research Laboratory. The government has rights in the invention. --

Signed and Sealed this

Twenty-fourth Day of August, 2004

JON W. DUDAS
*Director of the United States Patent and Trademark Office*